US005573128A

United States Patent [19]

Tsujiguchi et al.

[11] Patent Number: 5,573,128

[45] Date of Patent: Nov. 12, 1996

[54] TAMPER-EVIDENT PLASTIC CAP WITH ENGAGING STOPPER PIECES

[75] Inventors: Yoichi Tsujiguchi; Osamu Ishii, both of Hiratsuka, Japan

[73] Assignee: Japan Crown Cork Co., Ltd., Tokyo, Japan

[21] Appl. No.: 396,783

[22] Filed: Mar. 1, 1995

[30] Foreign Application Priority Data

Apr. 27, 1994 [JP] Japan ..... 6-090289
Apr. 27, 1994 [JP] Japan ..... 6-090290

[51] Int. Cl.[6] ..... B65D 41/34

[52] U.S. Cl. ..... 215/252

[58] Field of Search ..... 215/252, 256, 215/250; 220/276

[56] References Cited

U.S. PATENT DOCUMENTS

| | | | |
|---|---|---|---|
| 4,352,436 | 10/1982 | Chartier et al. | 215/252 |
| 4,529,096 | 7/1985 | Chartier et al. | 215/252 |
| 4,573,601 | 3/1986 | Berglund | 215/252 |
| 4,577,770 | 3/1986 | Wright | 215/252 |
| 4,732,289 | 3/1988 | Granat et al. | 215/252 |
| 4,828,127 | 5/1989 | Young et al. | 215/252 |
| 5,033,632 | 7/1991 | Mattia et al. | 215/252 |
| 5,273,173 | 12/1993 | Debetencourt | 215/252 |
| 5,402,901 | 4/1995 | Carvalheiro et al. | 215/252 |

FOREIGN PATENT DOCUMENTS

| | | |
|---|---|---|
| 0096351 | 12/1983 | European Pat. Off. . |
| 0189346 | 7/1986 | European Pat. Off. . |
| 0225394 | 6/1987 | European Pat. Off. . |

*Primary Examiner*—Allan N. Shoap
*Assistant Examiner*—Nathan Newhouse
*Attorney, Agent, or Firm*—Sughrue, Mion, Zinn, Macpeak & Seas

[57] ABSTRACT

A plastic cap having a peripheral band 4 which is provided at the lower end of the skirt-like side wall portion of the cap body, wherein the lower end of the skirt-like side wall portion outwardly protrudes, the peripheral band 4 downwardly extends from the protruded portion 10 at the lower end via a breaking line 11 that is circumferentially formed leaving a plurality of bridges 12, a downwardly extending stopper piece 20 is disposed on the side of closing the cap with respect to at least one of the bridges 12, the stopper piece 20 comes into contact with the bridge 12 at the time of closing the cap, and the cap body and the peripheral band 4 turn together. There is no need of providing space for forming stoppers between the lower end of the skirt-like side wall and the upper end of the peripheral band portion. Therefore, the coupling portion between the two is easily formed by providing a breaking line in the subsequent working of cutting. The cap is integrally molded without the need of using a metal mold having complex surface shapes or a split mold, and the rate of production can be enhanced.

7 Claims, 6 Drawing Sheets

TAMPER-EVIDENT PLASTIC CAP WITH ENGAGING STOPPER PIECES

BACKGROUND OF THE INVENTION

1. Field of the Invention

The present invention relates to a plastic cap having a fact-of-opening indicating mechanism, i.e., having tamper-evident (TE) characteristics, which comprises a cap body made up of a top panel and a skirt-like side wall portion hanging down from the peripheral edge of the top panel, and a peripheral band portion provided at the lower end of the skirt-like side wall portion. More specifically, the invention relates to a plastic cap of the type in which the peripheral band portion that exhibits TE characteristics is secured upon engagement with the engaging protrusions such as ratchet pawls formed on the outer peripheral surface of a neck portion of a container at the time of opening the cap.

2. Description of the Prior Art

The plastic cap having TE characteristics has a structure in which a peripheral band portion is formed at a lower portion of the cap body via a weakened line. In a representative example, flexible flap pieces are formed on the inner surface of the peripheral band portion. In opening the cap, the flap pieces engage with the lower side of a jaw portion which is formed along the outer periphery of the neck portion of the container, whereby the peripheral band portion is secured. When the cap body is opened, the weakened line is broken, and the cap body and the peripheral band portion are separated from each other.

In the cap of the above-mentioned type, when the flap pieces that have engaged with the lower side of the jaw portion, the flap pieces are bent and are elongated or the flap pieces themselves undergo elastic elongation. Therefore, the weakened line is not readily broken when the cap is opened. That is, the weakened line may often be broken after it is attempted to open the cap and after the sealing by the cap body at the mouth of the container is removed, which is not satisfactory from the standpoint of TE characteristics.

As a cap that has improved the above-mentioned problem, there has been known the one in which the peripheral band portion is secured at the time of opening the cap not relying upon the engagement between the flap pieces of the peripheral band portion and the jaw portion of the container but relying upon the engagement between the protrusions provided on the inner peripheral surface of the peripheral band portion and ratchet pawls formed on the outer peripheral surface of the neck portion of the container (see Japanese Laid-Open Utility Model Publication No. 131362/1981). In the cap of this type, protrusions indicating the direction in which the cap is opened are provided along the inner peripheral surface of the peripheral band portion maintaining a predetermined distance. In opening the cap, therefore, the protrusions and the ratchet pawls on the outer peripheral surface at the neck portion of the container engage with each other in the circumferential direction, whereby the peripheral band portion is inhibited from rotating and the weakened line is readily broken, effectively solving the problem in that the weakened line is readily broken after the seal at the mouth of the container is removed.

In the cap of this type, however, a problem still remains in that when the cap is closed to tighten the mouth of the container, the protrusions formed along the inner peripheral surface of the peripheral band portion ride over the ratchet pawls at the neck portion of the container exerting a large suppressing force on the band portion, whereby the cap body only is turned in the closing direction and the weakened line is broken. In closing the cap, therefore, it is necessary that the peripheral band portion and the cap body are turned together.

According to the above-mentioned prior art (Japanese Laid-Open Utility Model Publication No. 131362/1981) as shown in FIG. 1 thereof, a suitable gap is formed between the lower end of the skirt-like side wall of the cap body and the peripheral band by coupling them together via a plurality of collapsible bridges 20, and stoppers 22 and 24 are formed on the lower end surface of the skirt-like side wall and on the upper end surface of the peripheral band portion. That is, the stopper 24 of the peripheral band portion is disposed on the side of closing the cap with respect to the stopper 22 on the skirt-like side wall. In closing the cap, therefore, the stopper 22 is readily brought into contact with the stopper 24. Accordingly, the cap body and the peripheral band portion turn together, and the bridges 20 are not broken at the time of closing the cap.

In the above-mentioned cap, however, stoppers 22 and 24 must be formed on the lower end surface of the skirt-like side wall and on the upper end surface of the peripheral band portion and, hence, the gap between the two (length of bridges 20) must be so increased as will be capable of forming stoppers. Therefore, the portion where the lower end surface of the skirt-like side wall and the upper end surface of the peripheral band portion stopper 24 of the peripheral band portion is disposed on the side of closing the cap with respect to the stopper 22 on the skirt-like side wall. In closing the cap, therefore, the stopper 22 is readily brought into contact with the stopper 24. Accordingly, the cap body and the peripheral band portion turn together, and the bridges 20 are not broken at the time of closing the cap.

In the above-mentioned cap, however, stoppers 22 and 24 must be formed on the lower end surface of the skirt-like side wall and on the upper end surface of the peripheral band portion and, hence, the gap between the two (length of bridges 20) must be so increased as will be capable of forming stoppers. Therefore, the portion where the lower end surface of the skirt-like side wall and the upper end surface of the peripheral band portion are coupled together is not formed by the subsequent working such as cutting that is carried out at the time of forming perforation but is formed simultaneously with the formation of the cap as a unitary structure.

In closing the cap, furthermore, the pushing force is directly exerted on the collapsible bridges 20, whereby the gap between the lower end surface of the skirt-like side wall and the upper end of the peripheral band portion is crushed and the bridges tend to be broken. Therefore, in order to prevent the bridges 20 from breaking by the crushing, it has been attempted to provide protuberances (spacer protuberances) between the lower end surface of the skirt-like side wall and the upper end surface of the peripheral band portion, the protuberances being connected to either one of them and extending toward the other side.

As described above, stoppers or bridges are formed in space between the lower end of the skirt-like side wall and the upper end of the peripheral band portion or spacer protuberances are formed therein depending upon the cases. Therefore, the plastic is integrally molded by using a complex metal mold, or a split mold is used by taking the rapping of mold into consideration, imposing limitation on the molding speed which is very unsatisfactory from the standpoint of productivity.

SUMMARY OF THE INVENTION

It is, therefore, an object of the present invention to provide a TE plastic cap of the type in which the peripheral band is secured at the time of opening the cap by utilizing engaging protrusions such as ratchet pawls formed on the outer peripheral surface of the neck portion of the container, the cap being produced maintaining very improved productivity.

According to the present invention, there is provided a plastic cap comprising a cap body made up of a top panel and a skirt-like side wall portion hanging down from the peripheral edge of the top panel, and a peripheral band portion which is provided at the lower end of said skirt-like side wall portion and having an outer diameter which is substantially larger than the outer diameter of said skirt-like side wall portion, wherein:

the inner surface at the upper portion of said skirt-like side wall portion is threaded so as to be brought into threaded engagement with the outer periphery at the neck portion of the container, the lower end of the skirt-like side wall portion is outwardly protruding, and said peripheral band is downwardly extending from the protruded portion at said lower end via a breaking line that is circumferentially formed leaving a plurality of bridge portions;

protrusions are formed on the inner peripheral surface on a lower portion of said peripheral band portion so as to come into engagement with engaging protrusions that are formed on the outer peripheral surface at the neck portion of the container;

a downwardly extending first stopper piece is formed on the inner surface of the protruded portion at the lower end of the skirt-like side wall portion, and a second stopper piece is formed at an upper portion of said peripheral band portion; and said second stopper piece is disposed on the side of closing the cap with respect to said first stopper piece, said first stopper piece comes into contact with said second stopper piece at the time of closing the cap, and said cap body and said peripheral band portion turn together.

According to the present invention, the second stopper piece is preferably at least one of the plurality of bridge portions but may be provided as a member which is quite separate from the bridge portions.

BRIEF DESCRIPTION OF THE DRAWINGS

FIG. 4 is a side sectional view illustrating a portion from the lower end of the skirt-like side wall to the peripheral band of the cap of FIG. 1, wherein

FIG. 8 is a side sectional view illustrating a portion from the lower end of the skirt-like side wall to the peripheral band of the cap of FIG. 1, wherein

DETAILED DESCRIPTION OF THE INVENTION

According to the present invention in which the peripheral band portion has a diameter which is larger than the diameter of the skirt-like side wall of the cap body, a stopper (first stopper) on the skirt-like side wall and a stopper (second stopper which may be a bridge having a stopper function) of the peripheral band portion are both located on the side of the inner peripheral surface of the peripheral band portion, and there is no need of providing space for forming stoppers between the lower end of the skirt-like side wall and the upper end of the peripheral band portion. After the cap is molded, therefore, the metal mold can be easily parted and, besides, the coupling portion between the two can be easily formed by providing a breaking line in a subsequent working which is based upon the cutting. In integrally molding the cap, therefore, there is no need to use a metal mold having a complex surface shape or to use a split mold, and the rate of production can be increased.

Besides, there is no need of providing undesired space between the lower end of the skirt-like side wall and the upper end of the peripheral band portion. Accordingly, the bridges coupling the breaking line do not receive stress produced by undesired crushing at the time of closing the cap, and the bridges are effectively prevented from being broken.

The invention will now be described by way of embodiments in conjunction with the accompanying drawings.

Figure 1:
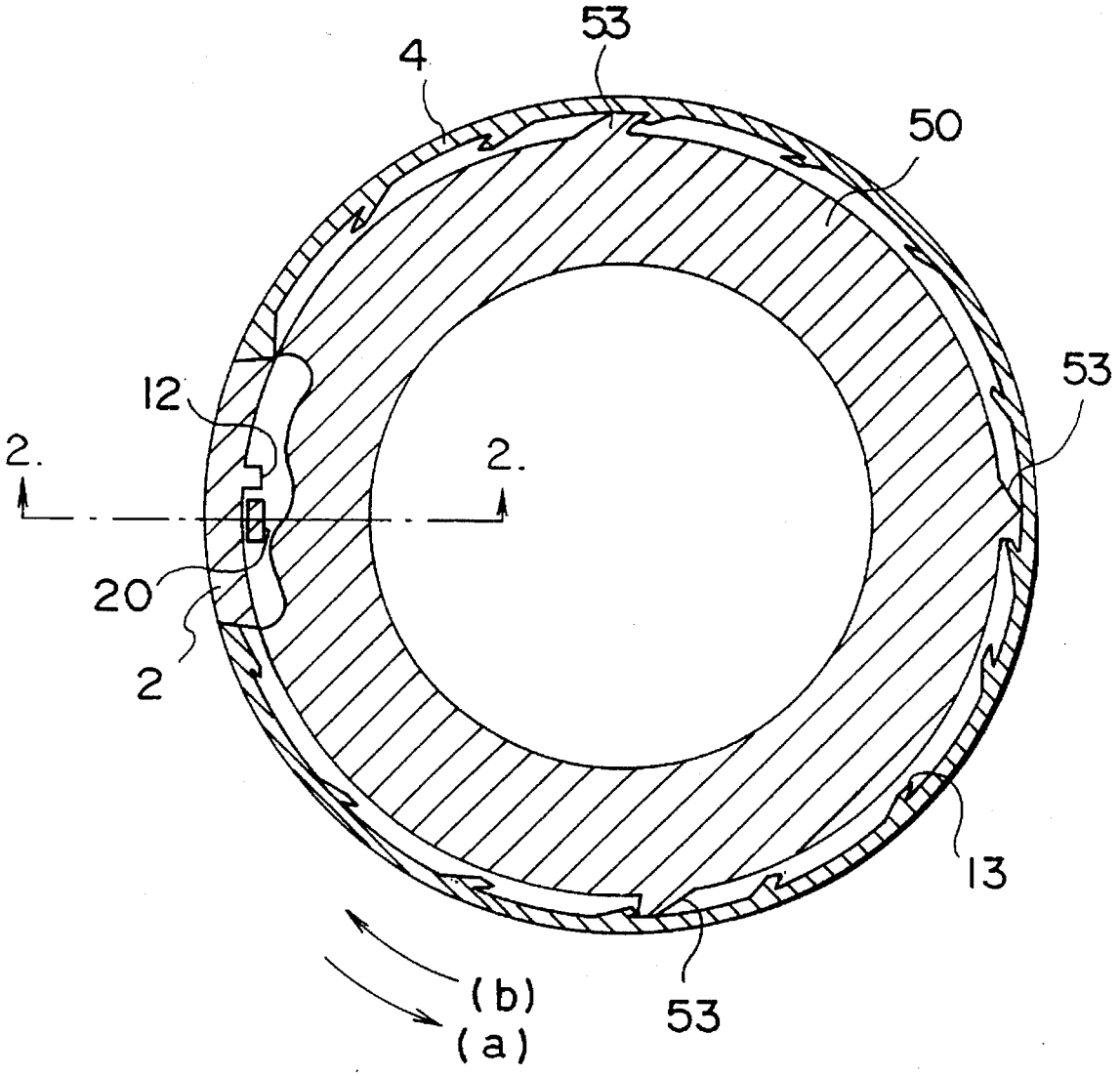
FIG. 1 is a diagram illustrating, in cross section and together with the wall of the container, the bottom surface of a plastic cap of the present invention utilizing bridge portions as the second stopper pieces.
Figure 2:
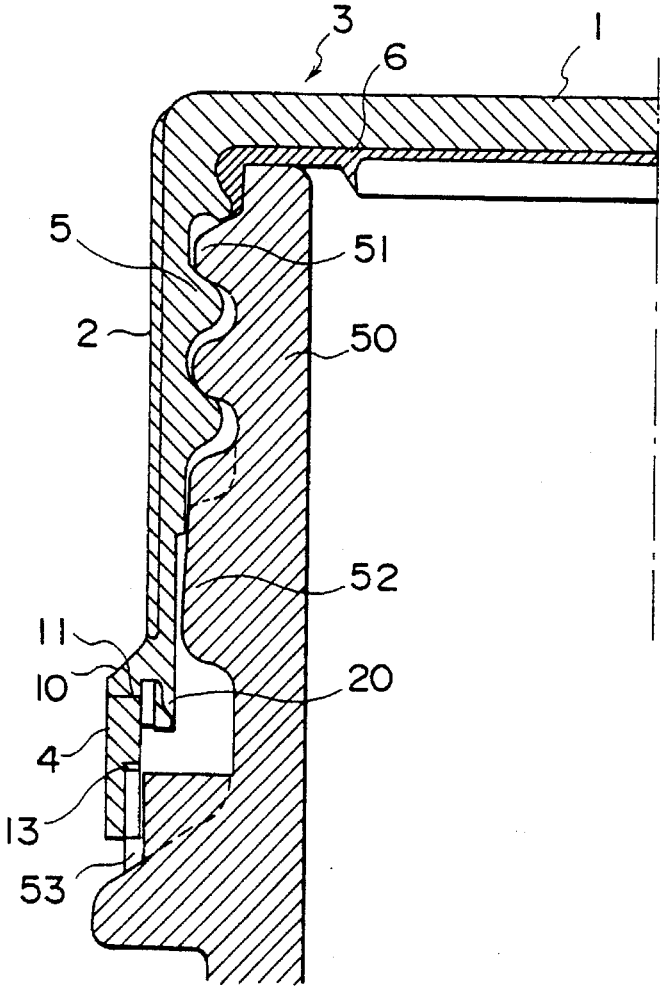
FIG. 2 is a sectional view of the cap along the line 2—2 in FIG. 1.

FIGS. 1 to 4 illustrate an embodiment of using bridge portions as the second stoppers, wherein FIG. 1 is a diagram illustrating the bottom surface of the cap in cross section and together with the wall of the container, and FIG. 2 is a side sectional view showing the cap of FIG. 1 together with the wall of the container.

In FIGS. 1 and 2, the cap comprises a cap body 3 made up of a top panel 1 and a skirt-like side wall 2 hanging down from the peripheral edge of the top panel 1, and a peripheral band 4 located on the lower side of the skirt-like side wall 2.

The upper portion of the inner peripheral surface of the skirt-like side wall 2 is threaded as designated at 5 to come into threaded engagement with a thread 51 that is formed in the outer peripheral surface at a neck portion 50 of the container. Due to this threaded engagement, the cap is tightened to the neck portion 50 of the container. A liner member 6 is provided on the inner surface of the top panel 1. When the cap is tightened, the liner member 6 comes into intimate contact with the upper end at the neck portion of the container (mouth of the container) to maintain sealing performance. In the neck portion 50 of the container is formed a jaw portion 52 on the lower side of the thread 51, and a plurality of ratchet pawls 53 are further formed on the lower side thereof.

An outwardly protruded portion 10 is formed at the lower end of the skirt-like side wall 2, and a peripheral band 4 is located at the lower end of the protruded portion 10 via a breaking line 11 (see FIG. 2). That is, the outer diameter of the peripheral band 4 is substantially larger than the outer diameter of the skirt-like side wall 2. A number of bridges 12 (see FIG. 1) are formed in the breaking line 11 maintaining a predetermined distance, and the lower end of the protruded portion 10 and the peripheral band 4 are coupled together by the bridges 12.

At the lower end of the peripheral band 4 are provided a number of protrusions 13 being directed in a direction in which the cap is opened (indicated by arrow a in FIG. 1) maintaining a predetermined distance. In opening the cap, the protrusions readily come into contact with the engaging protrusions such as ratchet pawls 53 formed at the neck portion of the container to prevent the peripheral band 4 from rotating. Therefore, before the sealing is removed between the liner member 6 and the mouth of the container, the bridges 12 are broken and the peripheral band 4 is separated away from the cap body 3. In this case, the ratchet pawls 53 at the neck portion of the container may be formed on the jaw portion 52.

According to the present invention, a stopper piece 20 is provided on the skirt-like side wall 2 near at least one bridge 12 in the direction in which the cap is opened. The stopper piece 20 corresponds to the first stopper piece.

Figure 3:
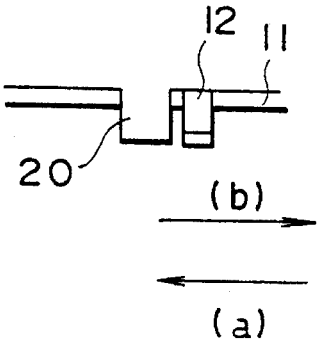
FIG. 3 is a diagram illustrating a positional relationship between the two stopper pieces provided in the cap of FIG. 1.
Figure 4A:
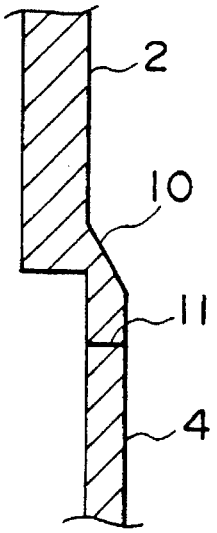
FIG. 4(A) is a side sectional view of a portion where neither stopper piece nor bridge is formed.

FIG. 3 shows a positional relationship of the stopper piece 20, and FIG. 4 is a side sectional view of a portion from the lower end of the skirt-like side wall 2 to the peripheral band 4. In FIG. 4, the diagram (A) is a side sectional view of a portion where neither the stopper piece nor the bridge is formed, the diagram (B) is a side sectional view of a portion where the bridge 12 is formed, and the diagram (C) is a side sectional view of a portion where the stopper piece 20 is formed. FIG. 4 does not illustrate the protrusions 13 that are provided at the lower end of the peripheral band 4.

Figure 4B:
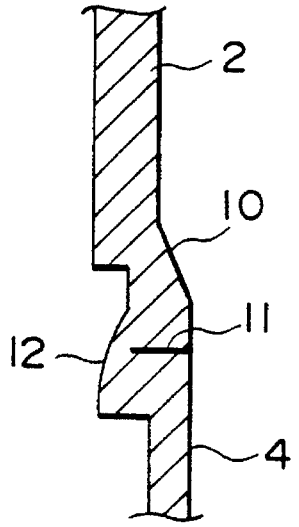
FIG. 4(B) is a side sectional view of a portion where a bridge 12 is formed.
Figure 4C:
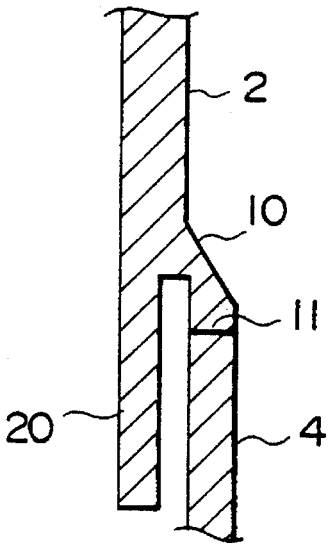
FIG. 4(C) is a side sectional view of a portion where a stopper piece is formed.

As will be obvious with reference to FIG. 3 in combination with FIG. 4, the stopper piece 20 downwardly extends from the root portion on the inner surface side of the protruding portion 10 at the lower end of the skirt-like side wall 2 [FIG. 4(C)], the bridge 12 has a size and a thickness so as to be overlapped on the stopper piece 20 [FIG. 4(B)], and the stopper piece 20 is disposed on the closing side with respect to the bridge [arrow (b)] (FIG. 3). Therefore, the bridge 12 works as the second stopper piece.

In closing the cap, suppressing force is exerted on the peripheral band 4 as the protrusions 13 provided at the lower end of the peripheral band 4 ride over the ratchet pawls 53. According to the present invention, however, the stopper piece 20 comes into contact with the bridge 12, whereby the cap body 3 and the peripheral band 4 turn together in the closing direction. Accordingly, no twisting force occurs between the two, and the bridges 12 are effectively prevented from breaking at the time of closing the cap. In this case, in order to enhance the contacting force between the bridge 12 and the stopper piece 20, it is desired to thickly form the lower portion of the bridge 12 as shown.

The above-mentioned cap of the present invention has a distinguished advantage in that it can be produced maintaining a very high productivity compared with the conventional widely known caps.

That is, in producing the cap of the present invention, a plastic is integrally molded to obtain a cap mold in a state where the breaking line 11 has not been formed. In this case, the wall portion corresponding to the bridge 12 is made thicker than the portion corresponding to the peripheral band 4 as shown in FIG. 4(B).

In the cap of the present invention as will be obvious from FIG. 4, no under-cut portion has been formed in the inner peripheral surface portion from the lower portion of the skirt-like side wall 2 to the peripheral band 4. After the molding, therefore, the metal mold can be easily released without requiring no excess release force. In integrally molding the cap, therefore, there is no need of using a metal mold having a complex shape or a split mold, and the molding can be carried out at high speeds by injection molding or compression molding.

After the molding operation, the breaking line 11 is formed by a widely known cutting working to obtain the cap of the present invention having the peripheral band 4 coupled to the lower end of the skirt-like side wall 2 via bridges 12.

In the cutting working as will be obvious from FIG. 4(B), the cutting line (corresponds to the breaking line 11) is set on the inside which is slightly smaller than the thickness of the peripheral band 4, in order to reliably form the structure having the peripheral band 4 which is coupled through the bridge portions 12 only.

Though the present invention described above shows one stopper piece 20 only, it is of course allowable to provide a plurality of stopper pieces 20. For instance, in order to reliably prevent the bridges from being broken, it is desired to provide the stopper pieces 20 in a number same as the number of the bridges. Depending upon the size of the cap, however, it is enough to provide only one stopper piece 20, or the stopper pieces 20 may be provided in a number of about four at positions symmetrical to one another.

It is desired that the lower end of the band 4 is made thin, that the side portion of the protrusions formed at the lower end of the peripheral band 4 is joined to the thin portion, and the upper portion continuous to the slide portion is joined to the lower portion of the thick portion. This makes it possible to increase the strength at a coupling portion between the protrusions 13 and the inner surface at the lower end of the peripheral band 4. In opening the cap, therefore, the protrusions 13 coming into contact with the ratchet pawls 53 are effectively prevented from being broken, whereby the TE function is reliably maintained. In the step of producing the cap, furthermore, the protrusions 13 are not deformed when the metal mold is released after the cap has been integrally molded; i.e., the metal mold is easily released.

It is of course allowable to secure the peripheral band at the time of opening the cap by using so-called flap pieces as the protrusions 13 and by bringing them into engagement with the flange portion of the container.

Though the above-mentioned embodiment has used the bridge 12 as the second stopper piece, it is allowable to provide the second stopper piece as a member which is separate from the bridge 12. This embodiment is shown in FIGS. 5 to 8.

Figure 5:
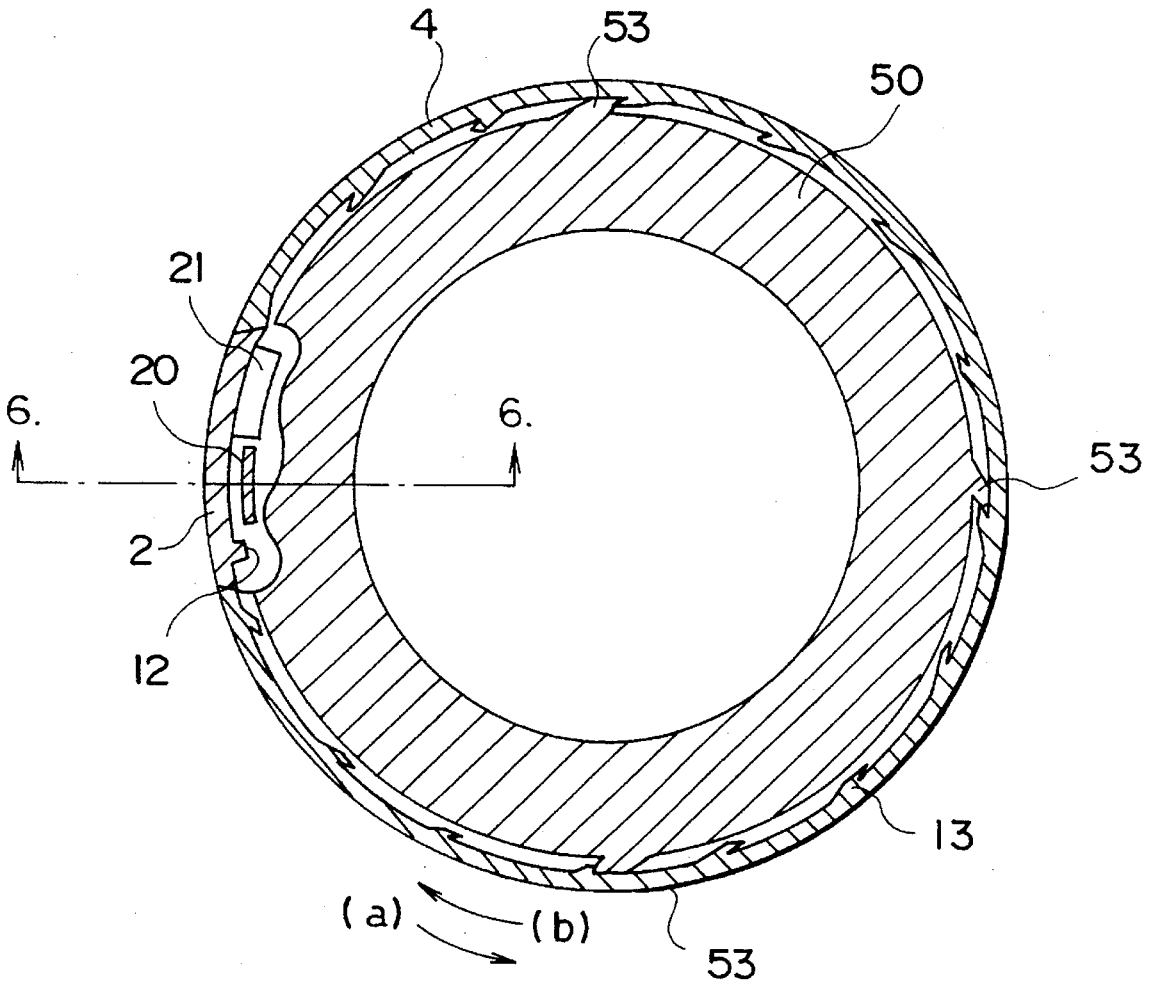
FIG. 5 is a diagram illustrating, in cross section and together with the wall of the container, the bottom surface of a plastic cap of the present invention in which the second stopper piece is formed separately from the bridge portion.
Figure 6:
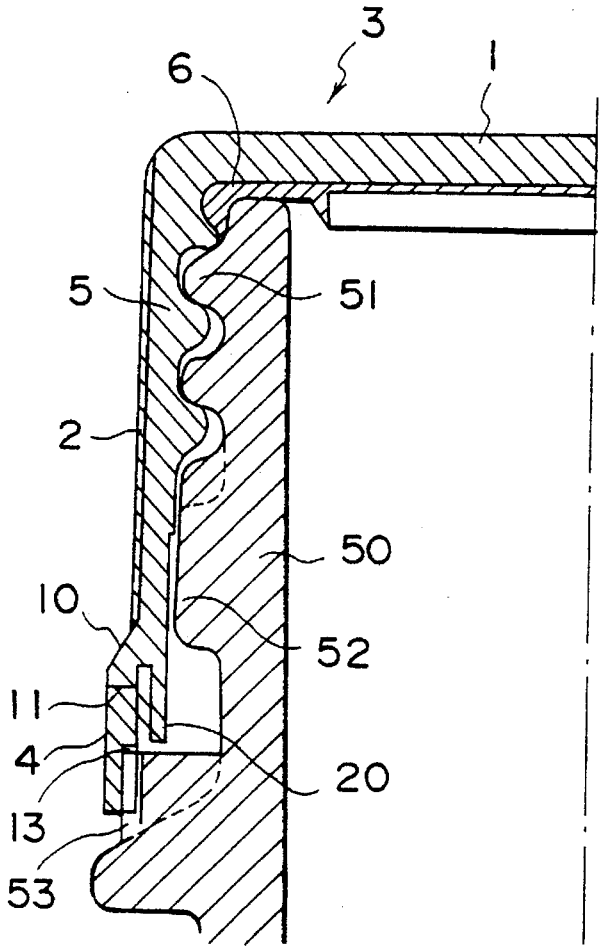
FIG. 6 is a side sectional view of the cap along the line 6—6 of FIG. 5.

FIG. 5 illustrates in cross section the bottom surface of the cap according to this embodiment, and FIG. 6 is a side sectional view of the cap of FIG. 5. According to this cap as will be obvious from FIGS. 5 and 6, the first stopper piece 20 is provided on the skirt-like side wall 2 between the bridges 12 which are neighboring to each other, and the second stopper piece 21 is provided on the peripheral band 4.

Figure 7:
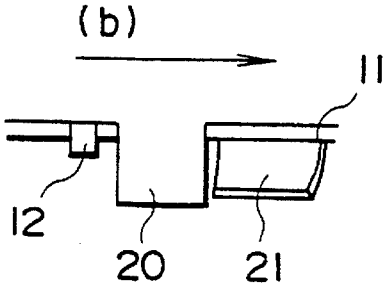
FIG. 7 is a diagram illustrating a positional relationship between the two stopper pieces provided in the cap of FIG. 5.

FIG. 7 illustrates a positional relationship of these stopper pieces, and FIG. 8 is a side sectional view showing a portion of from the lower end of the skirt-like side wall 2 to the peripheral band 4. In FIG. 8, the diagram (A) is a side sectional view of a portion where neither stopper piece nor bridge is formed, the diagram (B) is a side sectional view of a portion where a bridge 12 is formed, the diagram (C) is a side sectional view of a portion where a first stopper piece is formed, and the diagram (D) is a side sectional view of a portion where a second stopper piece is formed. Here, FIG. 8 does not show the protrusions 13 provided at the lower end of the peripheral band 4.

Figure 8A:
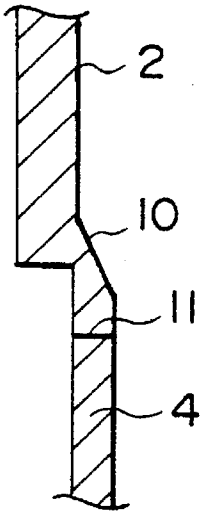
FIG. 8(A) is a side sectional view of a portion where neither stopper piece nor bridge is formed.
Figure 8B:
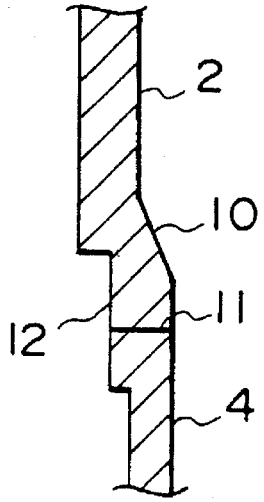
FIG. 8(B) is a side sectional view of a portion where a bridge 12 is formed.
Figure 8C:
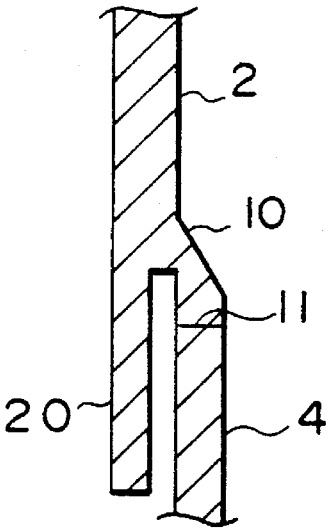
FIG. 8(C) is a side sectional view of a portion where a first stopper piece is formed.
Figure 8D:
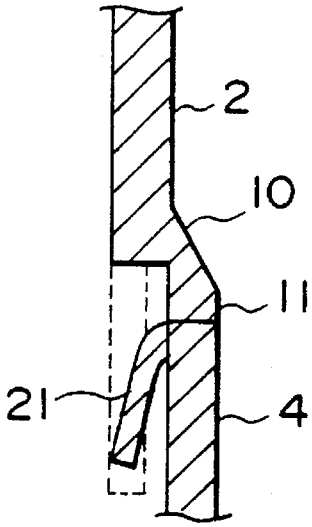
FIG. 8(D) is a side sectional view of a portion where a second stopper piece is formed.

As will be obvious with reference to FIG. 7 in combination with FIG. 8, the first stopper piece 20 downwardly extends from the root portion on the inner surface side of the lower protruded portion 10 of the skirt-like side wall 2 [FIG. 8(C)], and the second stopper piece 21 extends downwardly and inwardly from the upper end of the peripheral band 4 (a portion where the breaking line 11 is formed) being tilted in a manner that the outer diameter at the tip thereof becomes larger than the inner diameter of the first stopper piece 20 [FIG. 4(D)]. Moreover, the second stopper piece 21 is disposed on the side of closing the cap [arrow (b)] with respect to the first stopper piece 20 (FIG. 7).

In closing the cap, therefore, suppressing force is exerted on the peripheral band 4 as the protrusions 13 provided at the lower end of the peripheral band 4 ride over the ratchet pawls 53. According to the present invention, however, the first stopper piece 20 comes into contact with the second stopper piece 21, whereby the cap body 3 and the peripheral band 4 turn together in the closing direction. Accordingly, no twisting force occurs between the two, and the bridges are effectively prevented from breaking at the time of closing the cap.

Like the cap of FIG. 1, the above-mentioned cap of the present invention has a distinguished advantage in that it can be produced maintaining a very high productivity compared with the conventional widely known caps.

That is, in producing the cap, a plastic is integrally molded to obtain a cap mold in a state where the breaking line 11 has not been formed. In this case, the wall portion corresponding to the bridge 12 is made thicker than the portion corresponding to the peripheral band 4 as shown in FIG. 8(B).

Even in this cap as will be obvious from FIG. 8, no extremely under-cut portion has been formed in the inner peripheral surface portion from the lower portion of the skirt-like side wall 2 to the peripheral band 4. If flexibility is imparted to the second stopper piece 21, therefore, the metal mold can be easily released by giving a released force to some extent. In integrally molding the cap, therefore, there is no need of using a metal mold having a complex shape or a split mold, and the molding can be carried out at high speeds by injection molding or compression molding.

After the molding operation like in the case of the cap of FIG. 1, the breaking line 11 is formed by a widely known cutting working to obtain the cap of the present invention having the peripheral band 4 coupled to the lower end of the skirt-like side wall 2 via bridges 12.

Though FIG. 1 shows the first stopper piece 20 and the second stopper piece 21 in a pair only, it is of course allowable in the present invention to provide them in a plurality of pairs. Usually, it is desired to provide them in two pairs at symmetrical positions.

According to the TE plastic cap of the present invention in which the peripheral band is secured at the time of opening the cap by utilizing engaging protrusions such as ratchet pawls formed on the outer peripheral surface of the neck portion of the container, there is no need of providing space for forming stoppers between the lower end of the skirt-like side wall and the upper end of the peripheral band portion. Therefore, the coupling portion between the two can be easily formed by providing a breaking line in the subsequent working of cutting. Accordingly, the cap can be integrally molded without using a metal mold having complex surface shapes or a split mold, contributing to enhancing the rate of production.

We claim:

1. A plastic cap comprising a cap body made of a top panel and a side wall portion hanging down from the peripheral edge of the top panel, and a peripheral band portion which is provided at the lower end of said side wall portion and having an outer diameter which is substantially larger than the outer diameter of said side wall portion, wherein:

the inner surface at the upper portion of said side wall portion is threaded so as to be brought into threaded engagement with the outer periphery at the neck portion of a container, the lower end of the side wall portion is outwardly protruding, and said peripheral band portion is downwardly extending from the protruded portion at said lower end via a breaking line that is circumferentially formed leaving a plurality of bridge portions;

protrusions are formed on the inner peripheral surface on a lower portion of said peripheral band portion so as to come into engagement with engaging protrusions that are formed on the outer peripheral surface at the neck portion of a container;

a first stopper piece is formed on the side wall portion wherein said first stopper piece extends downwardly from the inner surface of the protruded portion and is spaced radially inwardly of the peripheral band portion and a second stopper piece formed at an upper portion of said peripheral band portion; and said second stopper piece is disposed on a side of closing the cap with respect to said first stopper piece, said first stopper piece comes into contact with said second stopper piece at the time of closing the cap, and said cap body and said peripheral band portion turn together.

2. A plastic cap according to claim 1, wherein said second stopper piece is at least one bridge portion.

3. A plastic cap according to claim 2, wherein the bridge portion that works as said second stopper piece is thicker toward the lower side thereof.

4. A plastic cap according to claim 1, wherein said second stopper piece is formed as a member which is separate from said bridge portion between the bridge portions that are neighboring to each other.

5. A plastic cap according to claim 4, wherein said second stopper piece is flexible and extends inwardly and downwardly.

6. A plastic cap according to claim 1, adapted to engage protrusions at the neck portion of a container having a plurality of ratchet pawls on the outer peripheral surface thereof, and wherein protrusions formed on the inner peripheral surface at the lower portion of said peripheral band portion are a plurality of flexible protuberances maintaining a predetermined distance and extending in a direction in which the cap is opened.

7. A plastic cap according to claim 1, wherein said breaking line is formed by a cutting process.

* * * * *